US006712655B1

(12) United States Patent
Schlemmer et al.

(10) Patent No.: US 6,712,655 B1
(45) Date of Patent: Mar. 30, 2004

(54) ADJUSTABLE ENGINE MOUNT BRACKET ASSEMBLY

(76) Inventors: Carl F. Schlemmer, 1455 Corey Way South, South Pasadena, FL (US) 33707; Carl A. Schlemmer, 1465 Corey Way South, South Pasadena, FL (US) 33707

( * ) Notice: Subject to any disclaimer, the term of this patent is extended or adjusted under 35 U.S.C. 154(b) by 0 days.

(21) Appl. No.: 10/389,867

(22) Filed: Mar. 17, 2003

(51) Int. Cl.[7] ..... B63H 21/30
(52) U.S. Cl. ..... 440/111
(58) Field of Search ..... 440/111; 248/637, 248/638, 671, 674

(56) References Cited

U.S. PATENT DOCUMENTS 2,046,558 A * 7/1936 Hussman ..... 440/111
4,003,330 A * 1/1977 Compton ..... 440/111
4,778,420 A 10/1988 Greenberg
4,778,421 A 10/1988 Greenberg
5,069,414 A 12/1991 Smith
5,211,592 A 5/1993 Alkema
5,478,264 A 12/1995 Law

* cited by examiner

*Primary Examiner*—Ed Swinehart
(74) *Attorney, Agent, or Firm*—Dennis G. LaPointe; Mason Law, P.A.

(57) ABSTRACT

A bracket assembly for securing an engine mount vibration isolator and for mounting an inboard engine on an engine support platform having stringers, the bracket assembly having an L-shaped member. A back-up plate sandwiches the stringer in between the L-shaped member and it. Longitudinal slots in the vertical leg and back-up plate provide for fore-aft adjustment and transverse slots in the horizontal leg provides for side to side adjustment. A horizontal plate with corresponding transverse slots is in a face to face relationship with either side of the horizontal leg of the L-shaped member. The horizontal plate has two recessed portions for insertion of a washer, each aligned with the corresponding transverse slot in the horizontal plate. The slots in the horizontal plate also serve to prevent the head of the fastening bolt or nut from rotating. Spacer plates are also available for height adjustment.

10 Claims, 9 Drawing Sheets

ADJUSTABLE ENGINE MOUNT BRACKET ASSEMBLY

The invention relates to improved engine-mounting brackets for mounting an inboard engine in a power boat or other vehicles with similar structural configuration on which an engine is supported.

Boat manufacturers typically install new engines at the plant and often special tooling facilitates the installation process. However, when engines are replaced, repaired or otherwise overhauled such that the engine must be removed and reinstalled in the field, it is often very difficult to reinstall the engine to the mounting blocks and its attachment to the hull support, and at the same time, properly align the engine for engagement with the propeller shaft. There is also difficulty aligning and/or placing and holding bolts in place for mounting the vibration isolator due to the limited accessibility and visibility of the area where the mounting bracket assembly is attached to the boat structural hull support. The hull support is typically a raised rail or stringer, which has a generally rectangular-shaped cross-section, that is, they are typically transversely spaced-apart inverted U-shaped longitudinal load bearing stringers, which are generally parallel to the longitudinal centerline of the boat.

Further, special tools are typically not available to workers repairing engines or swapping out engines in the field. The combination of the lack of such facilitating tools and the difficulty of aligning the bolts for the motor mount bracket assembly, while also trying to align the engine for coupling with the propeller shaft, makes such tasks time-consuming and arduous.

The present invention is an engine mounting bracket assembly that is adjustable to facilitate the alignment of the fasteners and designed to facilitate the placement and holding of the bolts in place without the need for special tooling, and at the same time allowing for and facilitating an accurate alignment with the propeller shaft. The invention thereby not only reduces the amount of time it takes to align the engine to the propeller shaft but also improves the accuracy of the alignment.

The engine mounting brackets currently available on the market lack the necessary adjustability and versatility to be used in different installation positions, while at the same time capable of self-securing the bottom side of the vertical fastener that holds the vibration isolators to the mounting bracket.

The present invention solves the functional difficulties associated with currently available brackets thereby reducing the time it takes to install and properly align the engine in a new boat on the assembly line as well as reducing the cost to the boat owner when the engine is realigned by a technician out in the field. Misaligned engines can cause many types of failures. These failures can include but are not limited to, transmission coupling, bearings and seals, stuffing box, cutless bearing, propeller shaft and/or coupling. These failures are very expensive to repair and will reoccur if the engine is not aligned properly.

While others have tried to solve some of the above problems, they lack the right combination of adjustability, versatility of use and the self-holding vertical fastener capability of the present invention. These three features are critical in most engine installations especially those with limited accessibility. For example, the bracket assembly disclosed in U.S. Pat. No. 4,778,420 to Greenberg and owned by Ray Industries, Inc., is an encapsulating L-shaped bracket assembly that caps the stringer. There is no versatility designed in the assembly such that the assembly can be installed in any other configuration described herein, as it can only be used as an end-cap to rest on the stringer. It can not be reversed vertically or rotated to be used on the side of the stringer. Further, there is no lateral (port-starboard) and longitudinal (fore-aft) adjustability built into the bracket assembly.

In many applications, an example of which is depicted in the Greenberg patent noted above, it is very difficult to reach the bottom side of the fasteners. When an application requires that the horizontal portion of the engine mounting bracket be positioned across the top of the stringer, access to the bottom side is very difficult. A commonly employed procedure is that the top of the stringer is cut away to provide access to hold the bottom side of the vibration isolator fastener as disclosed in U.S. Pat. No. 5,069,414 to Smith. Another commonly employed procedure is for the installer to have to fabricate a special wrench that will fit into the small space between the bottom of the engine mounting bracket and the top of the stringer for the purpose of securing the bottom side of the vibration isolator fastener. The self-holding feature design of the present invention will allow the installer to tighten the easily accessible top of the vertical fastener (nut or bolt head) and eliminates the need for extra help or a second tool to hold the bottom of the fastener.

Generally, the invention is an engine mounting bracket and back plate that has slots that make it adjustable in four directions, fore and aft, (front to back), and port and starboard (side to side). The bracket assembly also self secures the bottom side of the vertical fastener that holds a vibration isolator to the bracket. The bracket can be L-shaped (long leg upwardly directed) or inverted L-shaped and is typically made of aluminum and stainless steel.

The L-shaped member of the bracket assembly has two intended mounting surfaces, a vertical mounting surface on the L-shaped bracket member of the assembly that is used to mount the bracket to the stringer system of the hull of the boat and a horizontal mounting surface on the other leg of the L-shaped bracket member that is used to mount the vibration isolator to the bracket assembly.

A back-up plate member of the bracket assembly is used in conjunction with the L-shaped member for mounting to the stringer. The vertical leg of the L-shaped member and back-up plate have a plurality of spaced-apart slots (typically 2 to 6) that run parallel to the stringer, that is, longitudinally directed. These slots make the bracket assembly adjustable (fore and aft) parallel to the stringer system. The horizontal leg of the L-shaped member has parallel spaced-apart slots that run perpendicular to the stringer system, that is, the slots are laterally oriented and aligned perpendicular to the aforementioned slots on the vertical leg, which run longitudinally and are aligned parallel to the stringer system. These laterally oriented slots allow for adjustment of the vibration isolator side to side (port and starboard).

The bracket assembly also includes a horizontal plate, which attaches to the underside of the horizontal leg of the L-shaped member of the bracket assembly. Attachment of the horizontal plate can typically be done with machine screws threaded into the horizontal leg of the L-shaped member. The horizontal plate has two spaced-apart laterally directed slots that align with the overlying laterally directed slots in the horizontal leg of the L-shaped member. The combination of the slots in the L-shaped member, horizontal plate and back-up plate comprise the means for adjusting fore-aft and port-starboard positioning of the engine vibration isolators/engine and for facilitating an accurate alignment of the engine to the propeller shaft.

The top surface of the horizontal plate, that is, the side of the horizontal plate that is intended to be in a face-to-face relationship with the horizontal leg of the L-shaped member, has two spaced-apart laterally directed recessed portions aligned with and in an overlying relationship to the two spaced-apart slots in the horizontal plate, of sufficient depth to accommodate the sliding insertion of a washer in each groove through which, a bolt shank is passed through for securing the vibration isolator flanges. Further, the recessed portions or grooves are of a width wider than the underlying slots so that the washer is shouldered on the grooved out area. The slots in the horizontal plate are sized in width to allow the bolt head (or nut) to enter each slot and to prevent the bolt head (or nut) from rotating when tightening the nut (or bolt head) from above. The stringer will prevent the bolt head (or nut) from falling out.

It is preferred that the back-up plate be sized in width so that when the horizontal leg of the L-shaped member and its attached underlying horizontal plate are placed on top of a stringer, that a distal end of the horizontal leg of the L-shaped member is in an overlying relationship with an upper edge of the back-up plate. This will provide additional support for the bracket assembly.

The present invention is also versatile. It is effective for many different installation types and requirements. It can be installed as an inverted L, where the horizontal leg of the L-shaped member lays across the top of the boat's stringer system. It can also be used in installations where the vibration isolator is mounted inboard or outboard of the boat's stringer system where the horizontal leg of the L-shaped member faces away from the stringer to which it is bolted. The above described installation methods are most commonly used when installing twin engines in the hull of a boat. Another way the present invention can be used is by installing the bracket assembly in an L-shaped fashion, that is, with the horizontal leg of the L-shaped member being at the lower side against the stringer side wall and projecting away from the stringer side wall. This method is used when installing the engine on the inboard sides of the stringer system. This is commonly used in single engine boats or the outboard stringer of twin engine boats or boats with tall stringer system and will allow the placement of the engine lower in the hull of the boat. In these latter configurations, gussets can also be added near the inside outer edges of the L-shaped member, should additional strength be desired. Gussets can be attached by a number of ways known in the art such as by welding during manufacturing of the bracket assembly, or the gussets can be of sufficient thickness so as to attach the gussets with machine screws, where the head of the machine screw is recessed in the L-shaped member so as not protrude and interfere with the installation. Detachable gussets are recommended for the manufacture of a universal bracket system that will accommodate a number of installation configurations and requirements.

The versatility of the present invention allows the boat builder to install many different types and sizes of engines in the hull of a boat without having to relocate or modify the stringer system or to design a custom engine mounting bracket to accommodate each engine.

Before any engine mounting bracket can be bolted in place, the proper position relative to the boat's stringer system must be determined. This can be done in a variety of ways. The best method will be determined by the installer. Once the proper position is determined, the installer will drill horizontal holes in the boat's stringer that correspond to the slots in the vertical leg of the L-shaped member of the bracket system as well as the back-up plate. The L-shaped member and the back-up plate can then be bolted in place, sandwiching the stringer in between. The vibration isolator can then be placed on top of the slots in the horizontal leg of the L-shaped member. A washer can then be placed in each groove on the top surface in the horizontal plate that bolts to the underside of the horizontal leg of the L-shaped member. A bolt is then placed in the slot of the horizontal plate, through the washer, through the slot in the horizontal leg and finally through an aperture (typically a slot) in the flange or mounting pad portion of the vibration isolator. The process is repeated for the second fastener to secure the opposite flange of the vibration isolator. The bolts can be loosely tightened for later tightening. The process is completed for each engine mount. When the horizontal leg overlays the top of the stringer, the bolts and washers can be pre-installed before the L-shaped member is attached to the stringer. Two nuts are typically threaded on each mounting stud of the vibration isolator and a flat washer is typically placed over the uppermost nut. The lower nut acts as a locking nut. The engine can then be lowered into place on top of the studs that secure the engine to the vibration isolators. If necessary, spacer plates with slots that correspond in alignment to the slots in the horizontal plate and the horizontal leg of the L-shaped member can be inserted between the top of the horizontal leg of the L-shaped member and the bottom surface of the mounting pad portion of the vibration isolator to adjust the height of the vibration isolator. The engine and transmission can then be aligned to the propeller shaft coupling in the hull of the boat. When the alignment has been completed, all the fasteners can then be tightened securely.

The variety of available configurations presented by the design of the present invention allows the present invention to be used in a wide range of boat and stringer combinations as well as with different engines.

Figure 8:
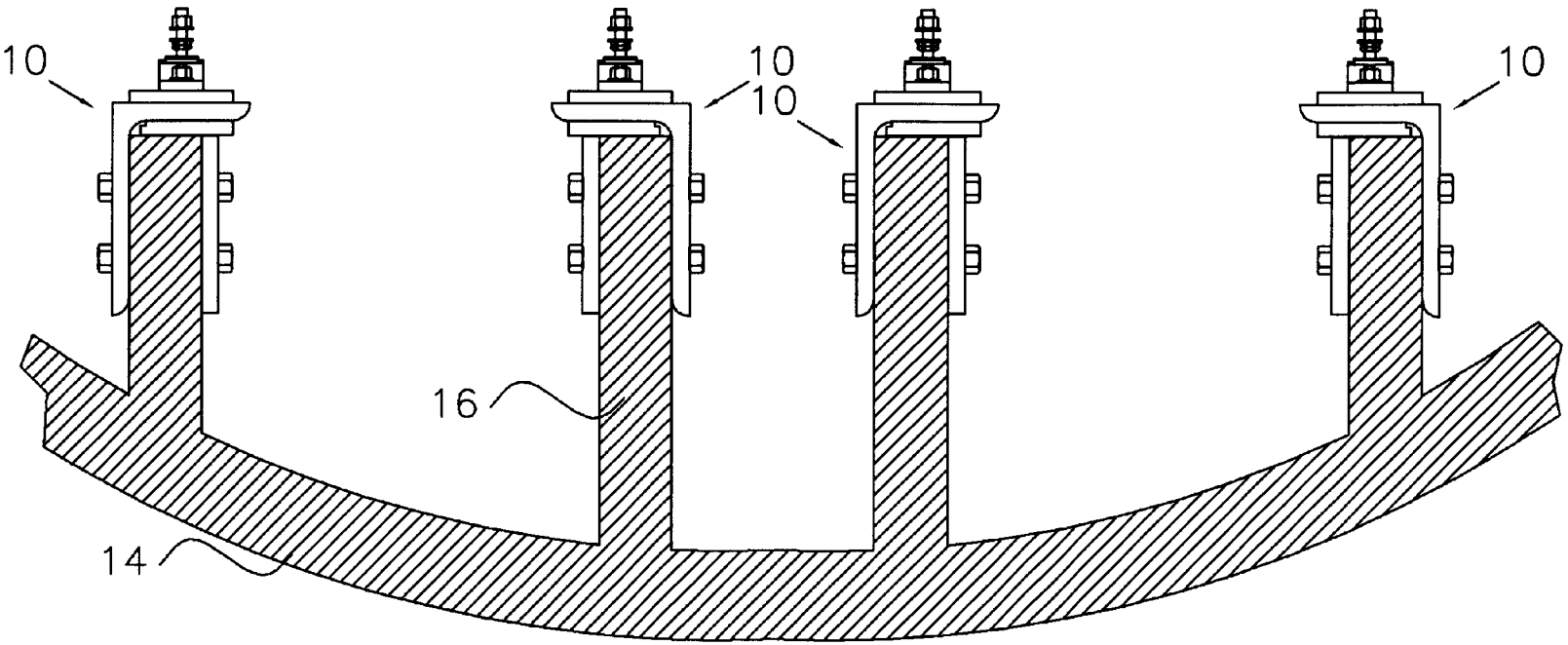
Figure 9:
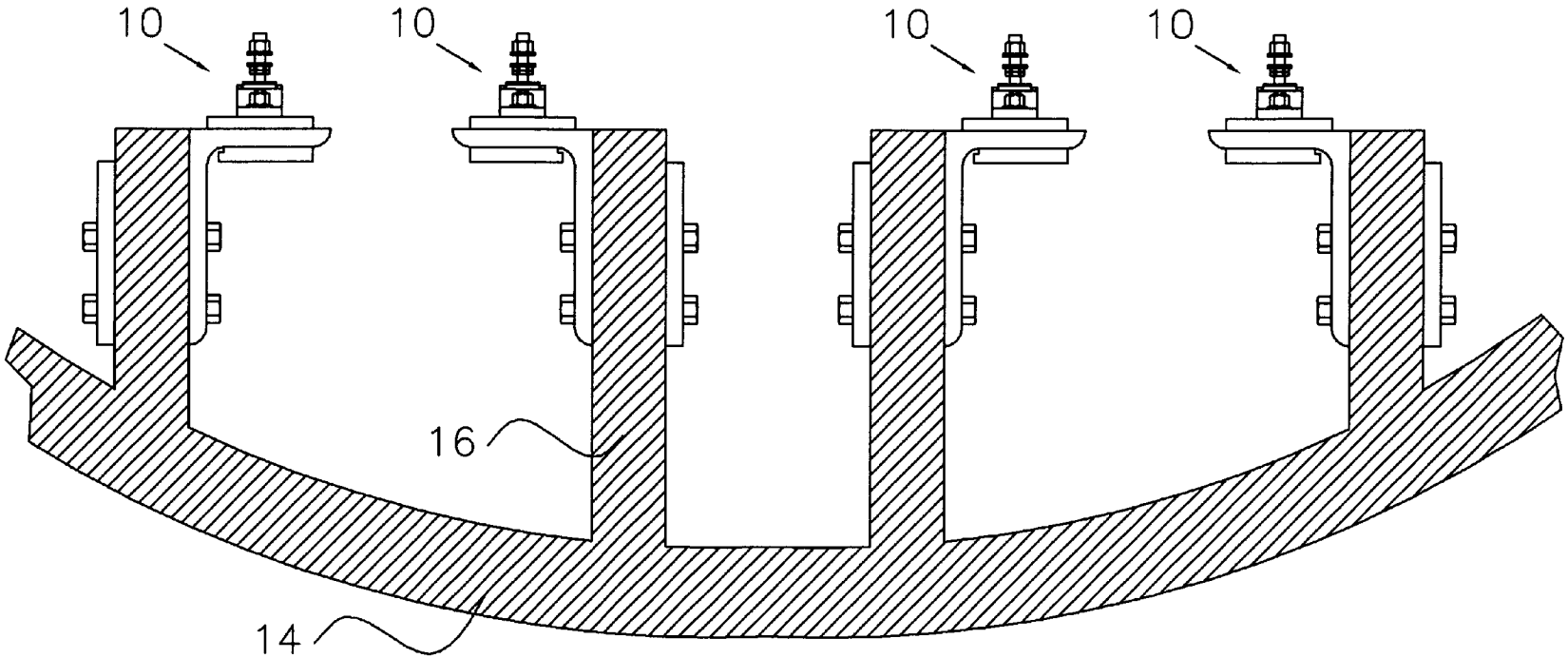

FIG. 8 is a schematic representation of the installation of the bracket assemblies to support a dual engine installation, where the L-shape member horizontal legs extend over the top of the stringers; and FIG. 9 is another representative depiction similar to that of FIG. 8, except the horizontal legs are essentially flush with the top surface of the stringers and/or inboard of the stringers, and is a configuration typically used when vibration isolators are placed inboard of stringers for mounting a narrow engine or when stringers are spaced far apart.

Referring now to the drawings, FIGS. 1–9, the present invention is an engine mounting bracket assembly, and is depicted generally as 10. More particularly, it is a bracket assembly 10 for securing an engine mount vibration isolator 12 and for mounting an inboard engine (not shown) on an engine support platform 14. Although the invention was originally designed for facilitating installations of engines on boats, for which in this application, the "engine support platform" is the hull or bilge area of a boat from which the stringers extend upwardly, it is foreseeable that other types of "vehicles" may have engines mounted in such a way that the present invention would be considered very useful.

The stringers 16 are load-bearing structural supports and are essentially transversely spaced-apart U-shaped longitudinal load-bearing structures, parallel to a longitudinal centerline of the engine support platform 14.

The bracket assembly 10 has an L-shaped member 18 of predetermined length comprising a horizontal leg 18*a* and a vertical leg 18*b*, the vertical leg 18*b* for selectively mounting against either side of one of the U-shaped stringers 16. The horizontal leg 18*a* has an upper surface 18*c* for mounting a vibration isolator 12.

The L-shaped member is essentially an angle-shaped channel stock material made from preferably stainless steel or aluminum, although it is anticipated that with today's polymer-carbon fiber composite technology that it could be designed to be made from such material as well. Certainly the back-up plate 20, horizontal plate 26 and/or the spacer plates 32 described in more detail below could be made from such polymer-carbon fiber composite material.

The back-up plate 20 is a plate approximately the length of the L-shaped member 18 and approximately the width of the vertical leg 18*b* of the L-shaped member 18. It is placed on the other side of the stringer (opposite the side to which the L-shaped member is placed) thereby sandwiching the U-shaped stringer 16 between the vertical leg 18*b* and the back-up plate 20.

Figure 1:
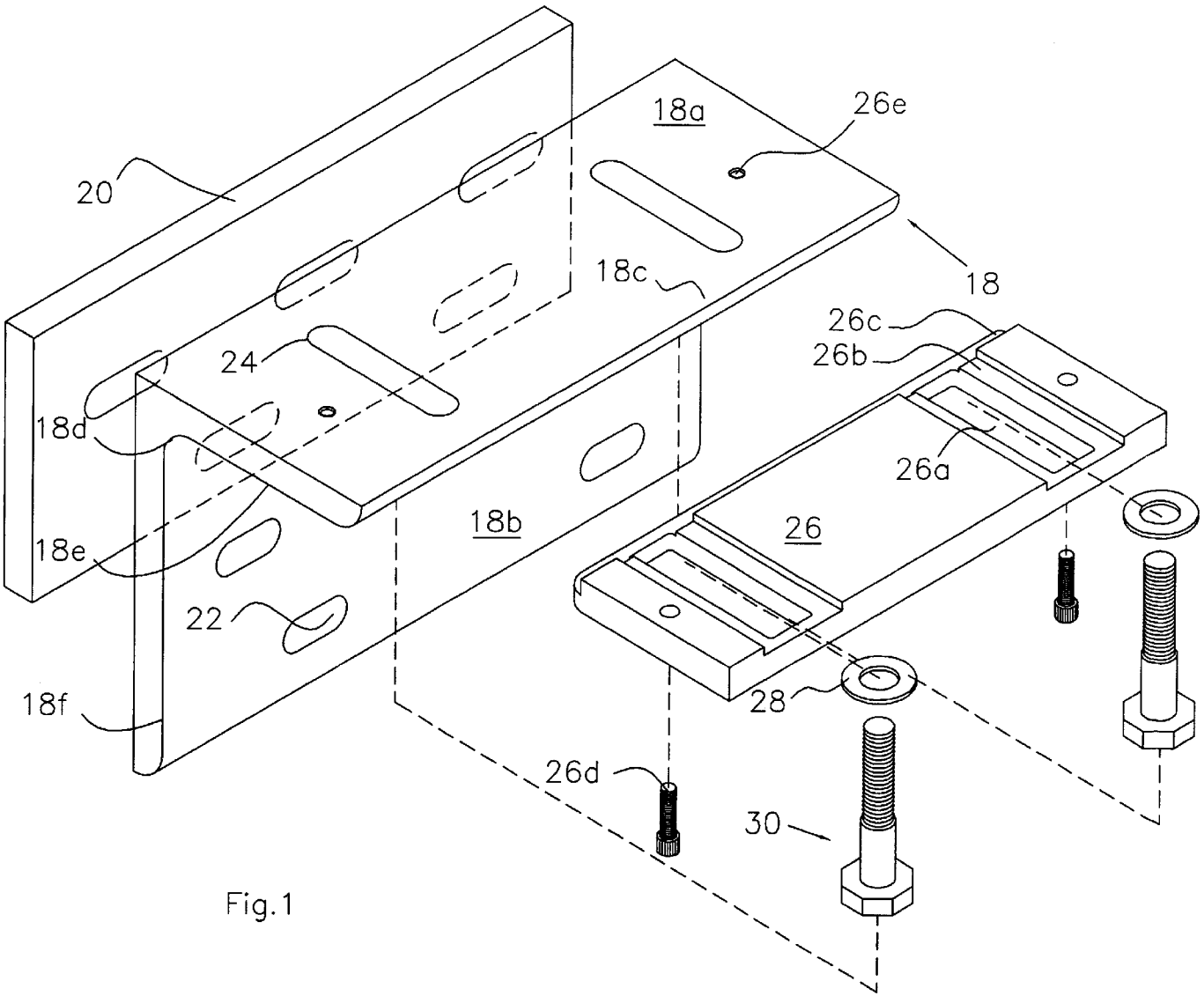
FIG. 1 is an exploded view of the typical components of the present invention.
Figure 2:
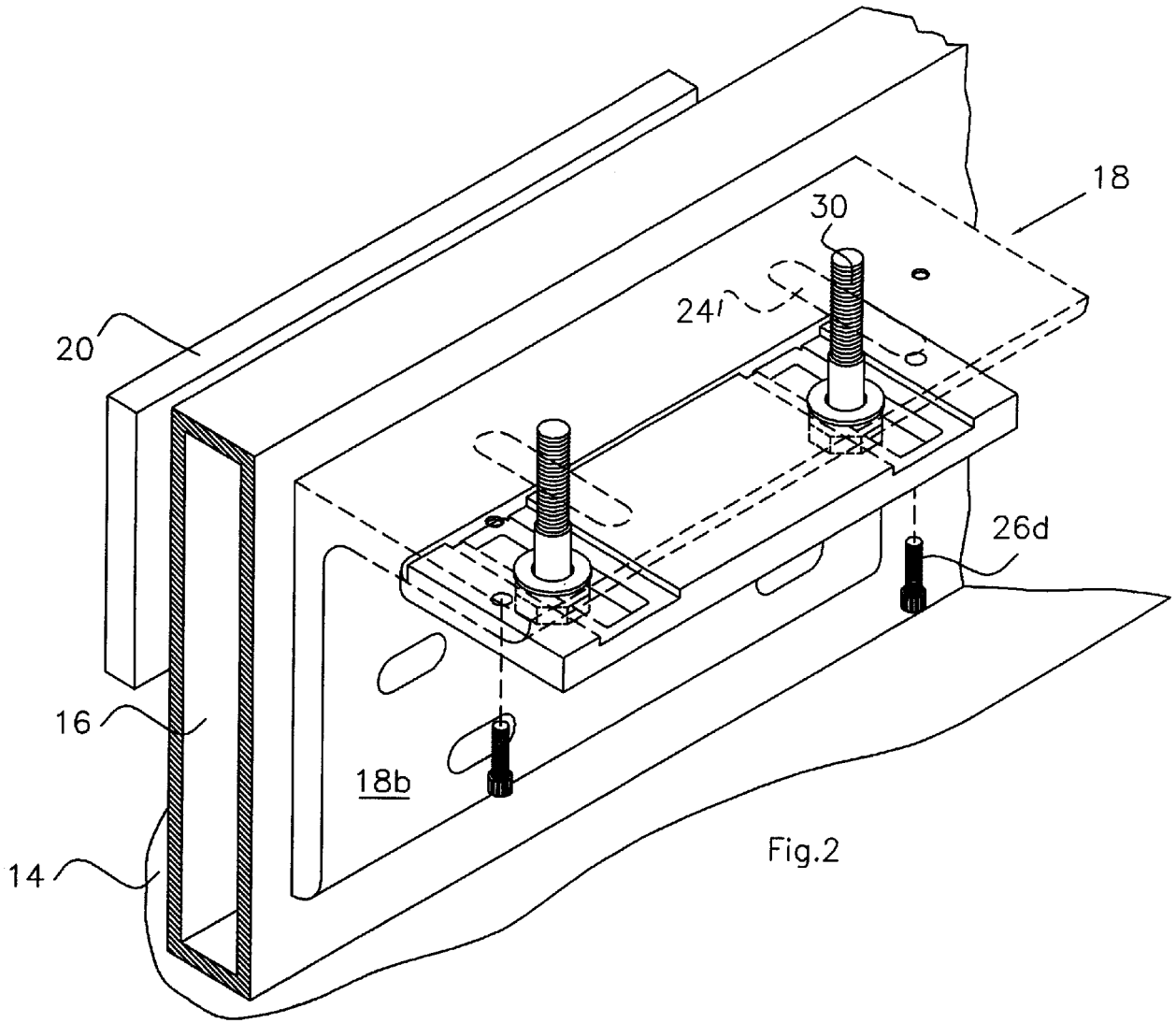
FIG. 2 is a depiction of the components of FIG. 1 further depicting the relationship of the stringer between the back-up plate and the L-shaped member.
Figure 3:
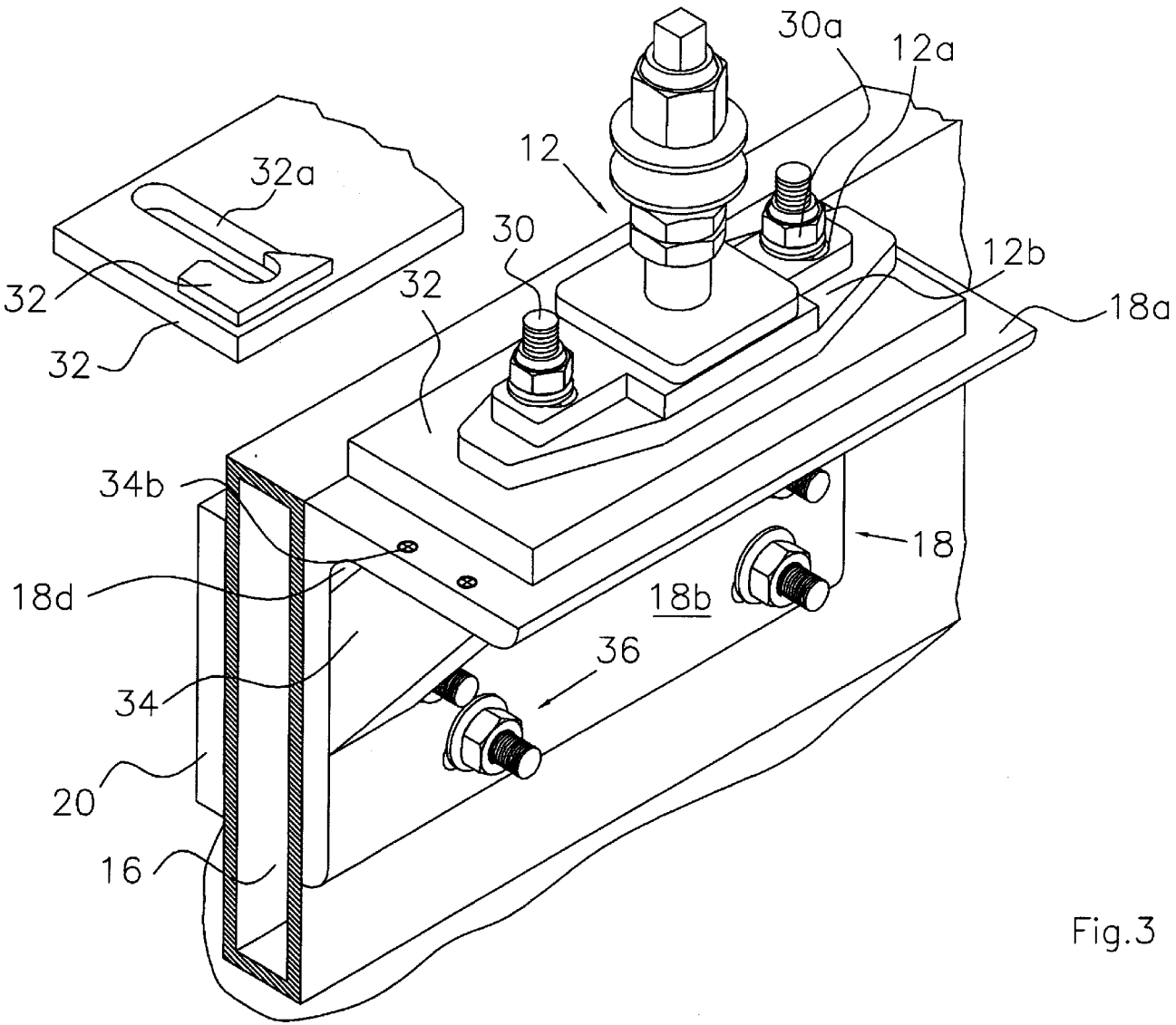
FIG. 3 is a depiction similar to FIG. 2 with the addition of gussets and of a spacer plate or optional thickness plate(s) between the vibration isolator and the L-shaped member.
Figure 4:
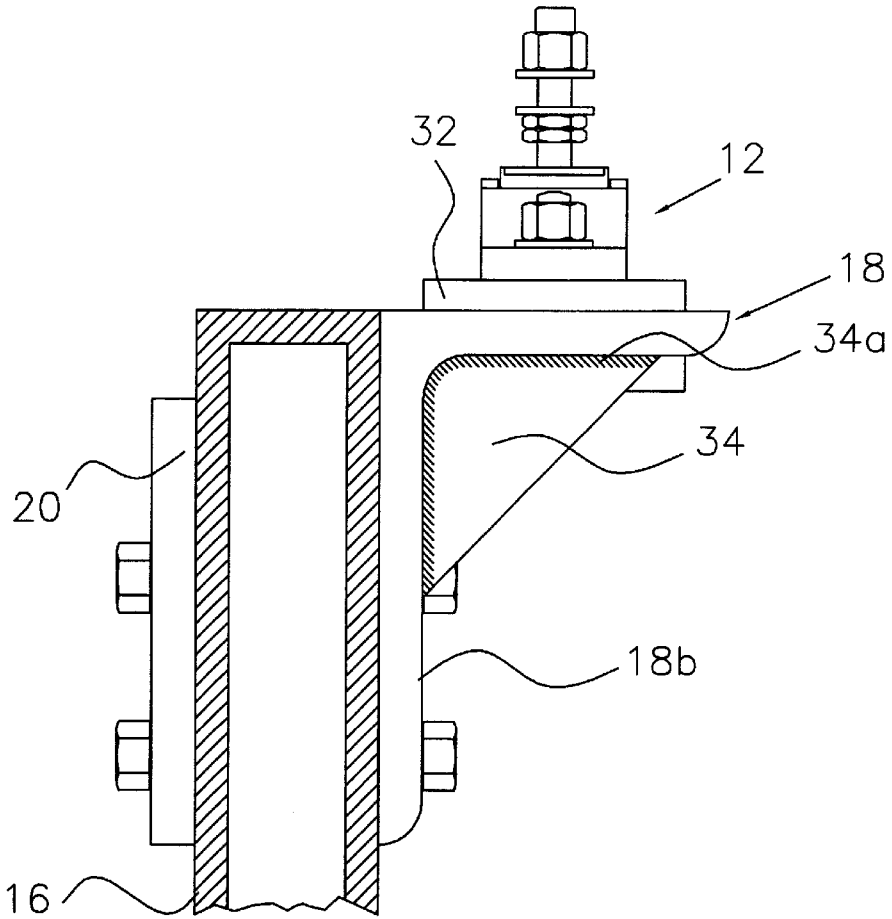
FIG. 4 is a side elevation depiction emphasize one embodiment where the gusset can be welded to the L-shaped member in lieu of bolting as shown in FIG. 3.
Figure 5:
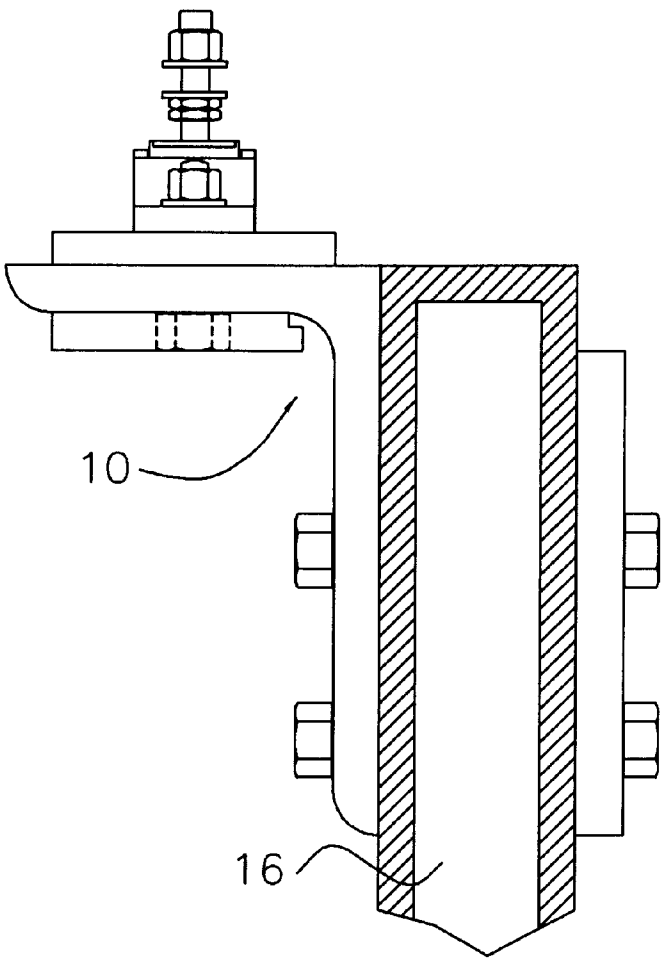
FIG. 5 is a depiction of a typical installation where the top of the bracket assembly L-shaped member is essentially level with the top of the stringers.
Figure 5:
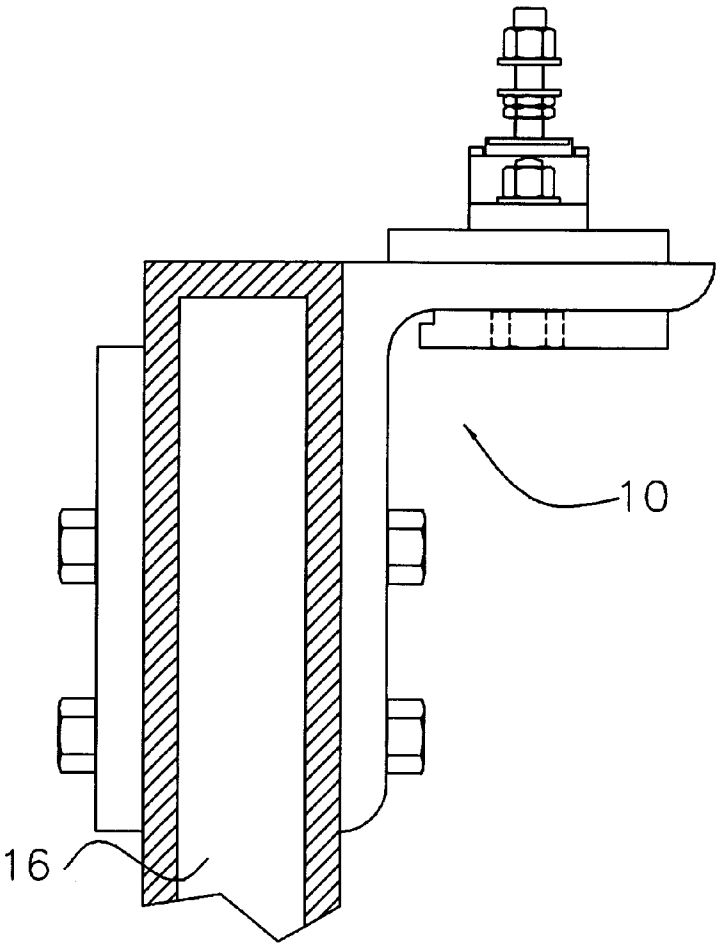
Figure 6:
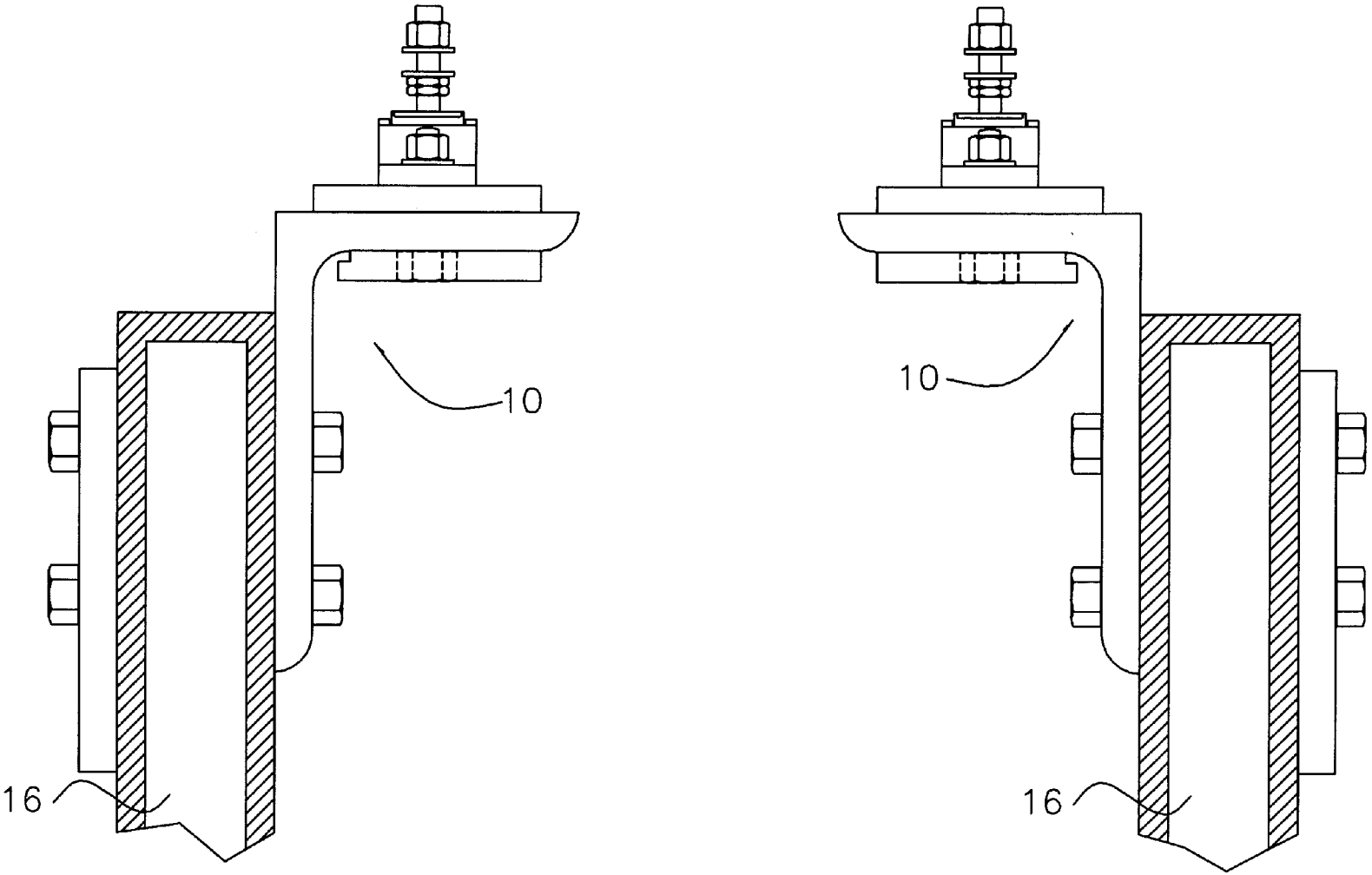
FIG. 6 is a depiction similar to that of FIG. 5 with an elevated installation of the bracket assembly.
Figure 7:
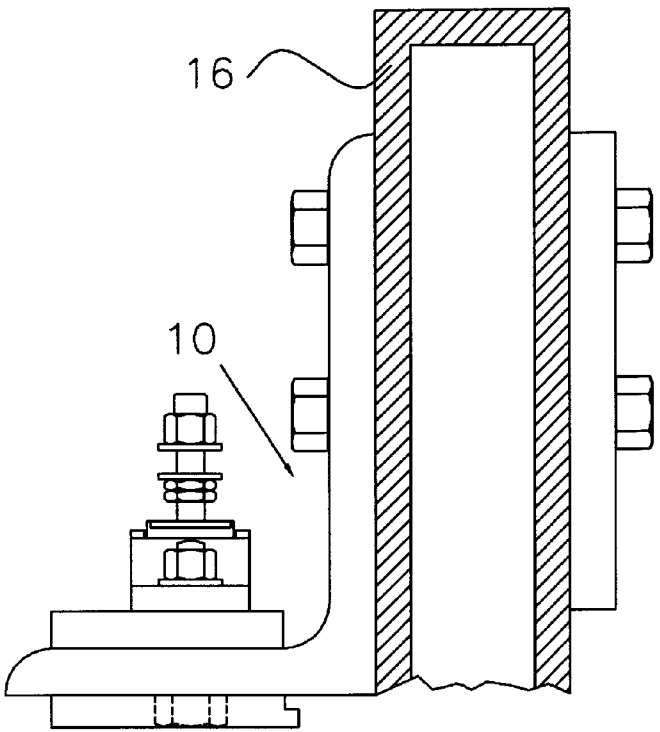
FIG. 7 is a depiction of another optional installation configuration with the L-shaped member inverted against the stringers to facilitate a lower profile installation of the engine.
Figure 7:
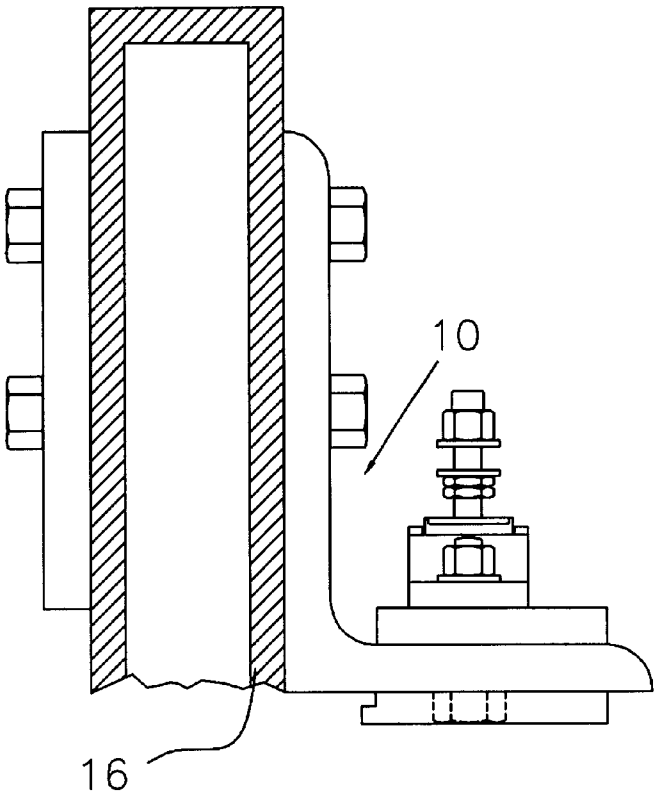

The L-shaped member can be mounted with the horizontal leg 18*a* on the upper side or inverted, for lower profile installations, as schematically depicted in FIG. 7.

The back-up plate 20 and the vertical leg 18*b* of the L-shaped member 18, each have an array of spaced-apart longitudinal slots 22, the slots 22 of the back-up plate 20 corresponding to and aligning with the slots 22 of the vertical leg 18*b*. The array of slots 22 in each of the back-up plate 20 and the vertical leg 18*b* of the L-shaped member 18 may include two parallel spaced-apart rows of slots. One row may have one long slot or two or three spaced-apart longitudinal slots and the other row may have one long slot or two or three spaced-apart longitudinal slots. The drawings show one example of one row of three slots and one row of two slots. Certainly, other array arrangements are contemplated and not all slots need be used for bolting the bracket assembly 10 to the stringers 16. The recommended arrays of two rows of two slots each, three slots each or alternative 3 and 2 (depicted in drawings for example purposes only) or 2 and 3 slots, provide very flexible alternatives to accommodate various installation configurations. Slots 22 depicted in the array shown in the drawings may, for example, be approximately 9/16 inches in width and approximately 1⅛ inches in length.

The horizontal slots 22 in the back-up plate 20 and vertical leg 18*b* thus provide for longitudinal (fore-aft) adjustment to facilitate alignment of the engine in this particular direction before final fastening in place using fasteners 36.

The horizontal leg 18*a* of the L-shaped member 18 has two transversely oriented parallel spaced-apart slots 24. These transversely oriented slots 24 align with corresponding fastener apertures 12*a* in a mounting pad portion 12*b* of the vibration isolator 12.

A horizontal plate 26 has an approximate width and length sufficient for overlaying in a face to face relationship with selectively, one of either side of the horizontal leg 18*a* of the L-shaped member 18. For example, FIG. 7 depicts the horizontal plate 26 on the opposite side as the depictions shown in the other drawings. The horizontal plate 26 has two transversely oriented parallel spaced-apart slots 26*a* located to align with the corresponding fastener apertures 12*a* in the mounting pad portion 12*b* of the vibrator isolator 12 and the transversely oriented parallel spaced-apart slots 24 in the horizontal leg 18*a* of the L-shaped member 18. The combination of these transversely oriented slots provides for lateral (side to side) adjustments for facilitating the alignment of the engine installation. Again, these slots may, for example, be about ½ inch in width and approximately 2¼ inches in length.

The horizontal plate 26 further has two spaced-apart transversely directed recessed portions 26*b*. Each recessed portion 26*b* is aligned with the corresponding transversely oriented slot 26*a* in the horizontal plate 26 and extends from at least one edge of the horizontal plate 26 past the transversely oriented slot 26*a*. Further, each recessed portion 26*b* has a width and depth sufficient to slide therein a washer 28, through which a shank of a fastening bolt 30 is to be inserted as it passes through the corresponding transversely oriented slots 26*a* in the horizontal plate 26 and transversely oriented slots 24 in the horizontal leg 18*a* of the L-shaped member 18. The recessed portion 26*b* is also located on a surface of the horizontal plate 26 which abuts in the face to face relationship with the horizontal leg 18*a* of the L-shaped member 18. For example, with the slots 26*a* about the size noted above, the typical size of the recess portion 26*b* may be about 1⅜ inches wide, ⅛–3/16 inch in depth, and may run the width of the horizontal plate 26 from one side to the other or end near the edge of the opposite side.

The two transversely oriented parallel spaced-apart slots 26*a* in the horizontal plate 26 also have a width sufficient to prevent a head of the fastening bolt 30 from rotating when engaging a mating nut 30*a* to a threaded end of the fastening bolt or to prevent a nut 30*a* from rotating when a threaded portion of a fastening bolt 30 is threaded into the nut 30*a*. With this feature, a second socket or wrench is not needed to hold the bolt or nut as it is being tightened. In tight areas, accessibility with standard tools is almost impossible, so special tooling (generally expensive) is needed. This feature eliminates the need for such additional tooling, thereby making the installation quicker and easier, especially on the hands and wrists.

As noted above, the horizontal plate 26 may be threadedly engaged with the horizontal leg 18*a* of the L-shaped member 18 from either side of the horizontal leg 18*a* of the L-shaped member 18, using screw 26*d* through 26*e* threaded aperture in horizontal leg 18*a*. In either configuration, the horizontal plate includes a notched out corner 26*c* along one longitudinal edge of the horizontal plate 26. This notched out corner 26*c* is a means for avoiding interference with the inside corner 18*d* of the L-shaped member 18 when the horizontal plate 26 is placed in the face to face relationship with the inside surface 18*e* of the horizontal leg 18*a* of the L-shaped member 18. Although the drawings depict a 90 degree notch, the corner can be notched in other ways, such as a beveled corner, as long as the plate does not ride upward against the generally typical rounded inside corner of the angle iron form comprising the L-shaped member.

If height adjustment is necessary beyond that, which can be accomplished by inverting the L-shaped member, and especially when the height of the vibration isolator has to be increased, one or more spacer plates 32 can be installed. Each spacer plate can be provided in various predetermined thicknesses for selective use as shims to raise the vibration isolator. The spacer plate(s) are inserted between the horizontal leg 18*a* of the L-shaped member 18 and the mounting pad portion 12*b* of the vibration isolator 12. Each spacer plate 32 further has transversely oriented slots 32*a* in alignment with corresponding slots 24,26*a* in the horizontal leg 18*a* of the L-shaped member 18 and the horizontal plate 26. The spacer plates 32 may typically be ⅛ inch, ¼ inch, ⅜ inch, ½ inch, ⅝ inch, ¾ inch, ⅞ inch, 1 inch, etc. Any combination and any fractional dimension of the preceding thicknesses may also be used. The spacer plates 32 may be made from a variety of materials from steel, stainless steel and aluminum to polymer base composites, including fiber reinforced polymeric-carbon fiber composites.

In certain situations, an L-shaped member 18 having inside gussets 34 near each of the inside outer edges 18*f* of the L-shaped member 18 may be desirable for additional strength. The gussets 34 may be made from a variety of materials from steel, stainless steel and aluminum to polymer base composites, including fiber reinforced polymeric or carbon fiber composites. The gussets 34 can either be fixed such as pre-welded (for gussets made from metal materials) as depicted by 34*a* in FIG. 4, or the gussets may be removably attached to the L-shaped member 18, using screws, such as the cap screws 34*b* depicted in FIG. 3. The latter is desirable, especially if the present invention 10 is sold as a field kit, with various combination of spacer plates 32. A field kit is especially desirable for mechanics in the field needing to install repaired or new engines.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

What is claimed is:

1. A bracket assembly for securing an engine mount vibration isolator and for mounting an inboard engine on an engine support platform having transversely spaced-apart U-shaped longitudinal load-bearing stringers parallel to a longitudinal centerline of said engine support platform, the bracket assembly comprising:

an L-shaped member of predetermined length comprising a horizontal leg and a vertical leg, the vertical leg for selectively mounting against either side of one of the U-shaped stringers, the horizontal leg having an upper surface for mounting a vibration isolator;

a back-up plate having a length proximate that of the L-shaped member, the back-up plate for placement in a face to face relationship with one of the sides of the U-shaped stringers opposite the side to which the vertical leg of the L-shaped member is placed thereby sandwiching the U-shaped stringer between the vertical leg and the back-up plate;

the back-up plate and the vertical leg of the L-shaped member, each having an array of spaced-apart longitudinal slots, the slots of the back-up plate corresponding in alignment with the slots of the vertical leg;

the horizontal leg of the L-shaped member having two transversely oriented parallel spaced-apart slots, the transversely oriented slots aligning with corresponding fastener apertures in a mounting pad portion of the vibration isolator;

a horizontal plate having a width and length sufficient for overlaying in a face to face relationship with selectively one of either side of the horizontal leg of the L-shaped member, the horizontal plate having two transversely oriented parallel spaced-apart slots located to align with the corresponding fastener apertures in the mounting pad portion of the vibrator isolator and the transversely oriented parallel spaced-apart slots in the horizontal leg of the L-shaped member; and the horizontal plate further having two spaced-apart transversely directed recessed portions, each recessed portion being aligned with the corresponding transversely oriented slot in the horizontal plate and extending from at least one edge of the horizontal plate past said transversely oriented slot, each recessed portion having a width and depth sufficient to slide therein a washer through which a shank of a fastening bolt is to be inserted as it passes through the corresponding transversely oriented slots in the horizontal plate and the horizontal leg of the L-shaped member, the recessed portion also being located on a surface of the horizontal plate which abuts in the face to face relationship with the horizontal leg of the L-shaped member, wherein the longitudinal slots in the vertical leg of the L-shaped member and in the backup plate provide for fore and aft longitudinal adjustment when installing the bracket assembly, and wherein the transversely oriented slots in the horizontal plate and the horizontal leg of the L-shaped member provide for side to side adjustment when installing the bracket system.

2. The bracket assembly according to claim 1, wherein the two transversely oriented parallel spaced-apart slots in the horizontal plate have a width sufficient to prevent a head of the fastening bolt or nut from rotating when engaging a mating nut to a threaded end of the fastening bolt or bolt to the mating nut.

3. The bracket assembly according to claim 1, wherein the array of slots in each of the back-up plate and the vertical leg of the L-shaped member comprises two parallel spaced-apart rows of at least one longitudinal slot in each row.

4. The bracket assembly according to claim 1, wherein the horizontal plate is selectively threadedly engageable with the horizontal leg of the L-shaped member from either side of the horizontal leg of the L-shaped member.

5. The bracket assembly according to claim 1, wherein the horizontal plate includes a notched out corner along one longitudinal edge of the horizontal plate, the notched out corner for avoiding interference with an inside corner of the L-shaped member when said horizontal plate is placed in the face to face relationship with the inside surface of the horizontal leg of the L-shaped member.

6. The bracket assembly according to claim 1, further comprising:

one or more spacer plates, each of predetermined thicknesses, for selective insertion between the horizontal leg of the L-shaped member and the mounting pad portion of the vibration isolator, each spacer plate further having transversely oriented slots in alignment with corresponding slots in the horizontal leg of the L-shaped member and the horizontal plate, wherein the one or more spacer plates provide for height adjustment of the engine being installed.

7. The bracket assembly according to claim 1, further comprising:

a gusset near each of the inside outer edges of the L-shaped member, the gussets being one of fixedly engaged with the L-shaped member and removably attached to the L-shaped member.

8. A bracket assembly kit for facilitating the securing of an engine mount vibration isolator and for mounting an inboard engine on an engine support platform having transversely spaced-apart U-shaped longitudinal load-bearing stringers parallel to a longitudinal centerline of said engine support platform, the bracket assembly comprising:

an L-shaped member of predetermined length comprising a horizontal leg and a vertical leg, the vertical leg for selectively mounting against either side of one of the U-shaped stringers, the horizontal leg having an upper surface for mounting a vibration isolator;

a back-up plate having a length proximate that of the L-shaped member, the back-up plate for placement in a face to face relationship with one of the sides of the U-shaped stringers opposite the side to which the vertical leg of the L-shaped member is placed thereby sandwiching the U-shaped stringer between the vertical leg and the back-up plate;

the back-up plate and the vertical leg of the L-shaped member, each having an array of spaced-apart longitudinal slots, the slots of the back-up plate corresponding in alignment with the slots of the vertical leg;

the horizontal leg of the L-shaped member having two transversely oriented parallel spaced-apart slots, the transversely oriented slots aligning with corresponding fastener apertures in a mounting pad portion of the vibration isolator;

a horizontal plate having a width and length sufficient for overlaying in a face to face relationship with selectively one of either side of the horizontal leg of the L-shaped member, the horizontal plate having two transversely oriented parallel spaced-apart slots located to align with the corresponding fastener apertures in the mounting pad portion of the vibrator isolator and the transversely oriented parallel spaced-apart slots in the horizontal leg of the L-shaped member;

the horizontal plate further having two spaced-apart transversely directed recessed portions, each recessed portion being aligned with the corresponding transversely oriented slot in the horizontal plate and extending from at least one edge of the horizontal plate past said transversely oriented slot, each recessed portion having a width and depth sufficient to slide therein a washer through which a shank of a fastening bolt is to be inserted as it passes through the corresponding transversely oriented slots in the horizontal plate and the horizontal leg of the L-shaped member, the recessed portion also being located on a surface of the horizontal plate which abuts in the face to face relationship with the horizontal leg of the L-shaped member;

the horizontal plate further having a notched out corner along one longitudinal edge of the horizontal plate, the notched out corner for avoiding interference with an inside corner of the L-shaped member when said horizontal plate is placed in the face to face relationship with the inside surface of the horizontal leg of the L-shaped member;

one or more spacer plates, each of predetermined thicknesses, for selective insertion between the horizontal leg of the L-shaped member and the mounting pad portion of the vibration isolator, each spacer plate further having transversely oriented slots in alignment with corresponding slots in the horizontal leg of the L-shaped member and the horizontal plate, wherein the longitudinal slots in the vertical leg of the L-shaped member and in the backup plate provide for fore and aft longitudinal adjustment when installing the bracket assembly, wherein the transversely oriented slots in the horizontal plate and the horizontal leg of the L-shaped member provide for side to side adjustment when installing the bracket system, and wherein the one or more spacer plates provide for height adjustment of the engine being installed.

9. The bracket assembly kit according to claim 8, wherein the horizontal plate is selectively threadedly engageable with the horizontal leg of the L-shaped member from either side of the horizontal leg of the L-shaped member.

10. The bracket assembly kit according to claim 8, further comprising:

a gusset near each of the inside outer edges of the L-shaped member, the gussets being one of fixedly engaged with the L-shaped member and removably attached to the L-shaped member.

* * * * *